US006364752B1

(12) United States Patent
Kimura et al.

(10) Patent No.: US 6,364,752 B1
(45) Date of Patent: Apr. 2, 2002

(54) METHOD AND APPARATUS FOR DRESSING POLISHING CLOTH

(75) Inventors: Norio Kimura; You Ishii, both of Fujisawa; Toyomi Nishi, Yokohama; Takayoshi Kawamoto, Chigasaki; Takeshi Sakurai, Yokohama, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 08/881,616

(22) Filed: Jun. 25, 1997

(30) Foreign Application Priority Data

Jun. 25, 1996 (JP) ..... 8-184012

(51) Int. Cl.[7] ..... B24B 7/22

(52) U.S. Cl. ..... 451/56; 451/443; 451/444; 451/21; 451/22; 451/6

(58) Field of Search ..... 451/21, 41, 56, 451/6, 22, 443, 444

(56) References Cited

U.S. PATENT DOCUMENTS

| | | | | |
|---|---|---|---|---|
| 4,984,390 A | | 1/1991 | Kobayashi | |
| 5,384,986 A | * | 1/1995 | Hirose et al. | 451/56 |
| 5,456,627 A | * | 10/1995 | Jackson et al. | 451/11 |
| 5,486,131 A | | 1/1996 | Cesna et al. | |
| 5,618,447 A | | 4/1997 | Sandhu | |
| 5,626,509 A | * | 5/1997 | Hayashi | 451/285 |
| 5,698,455 A | * | 12/1997 | Meikle et al. | 451/56 |
| 5,708,506 A | * | 1/1998 | Birang | 451/6 |
| 5,743,784 A | * | 4/1998 | Birang et al. | 451/56 |
| 5,875,559 A | | 3/1999 | Birang et al. | |
| 5,954,570 A | | 9/1999 | Yano et al. | |
| 5,984,764 A | * | 11/1999 | Saito | 451/56 |

FOREIGN PATENT DOCUMENTS

| | | |
|---|---|---|
| EP | 0 589 434 | 3/1994 |
| GB | 907 954 | 10/1962 |
| JP | 62-162460 | 7/1987 |

* cited by examiner

*Primary Examiner*—George Nguyen
(74) *Attorney, Agent, or Firm*—Wenderoth, Lind & Ponack, L.L.P.

(57) ABSTRACT

A polishing cloth mounted on a turntable is dressed by bringing a dresser in contact with the polishing cloth for restoring the polishing capability of the polishing cloth. The dressing is performed by measuring heights of a surface of the polishing cloth at radial positions of the polishing cloth in a radial direction thereof, determining a rotational speed of the dresser with respect to a rotational speed of the turntable on the basis of the measured heights, and dressing the polishing cloth by pressing the dresser against the polishing cloth while the turntable and the dresser are rotating. The dresser has an annular diamond grain layer or an annular SiC layer.

20 Claims, 9 Drawing Sheets

METHOD AND APPARATUS FOR DRESSING POLISHING CLOTH

BACKGROUND OF THE INVENTION

1. Field of the Invention

The present invention relates to a method and apparatus for dressing a polishing cloth, and more particularly to a method and apparatus for dressing a polishing cloth for restoring the polishing capability of the polishing cloth in a polishing apparatus for polishing a workpiece such as a semiconductor wafer having a device pattern thereon to a flat mirror finish by bringing the surface of the workpiece into contact with a surface of the polishing cloth.

2. Description of the Prior Art

Recent rapid progress in semiconductor device integration demands smaller and smaller wiring patterns or interconnections and also narrower spaces between interconnections which connect active areas. One of the processes available for forming such interconnections is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus, and such a process is called Chemical Mechanical Polishing (CMP). In CMP the semiconductor wafers are chemically and mechanically polished while supplying an abrasive liquid comprising abrasive grains and a chemical solution such as an alkaline solution.

Conventionally, a polishing apparatus has a turntable and a top ring which rotate at respective individual speeds. A polishing cloth is attached to the upper surface of the turntable. A semiconductor wafer to be polished is placed on the polishing cloth and clamped between the top ring and the turntable. An abrasive liquid containing abrasive grains is supplied onto the polishing cloth and retained on the polishing cloth. During operation, the top ring exerts a certain pressure on the turntable, and the surface of the semiconductor wafer held against the polishing cloth is therefore polished to a flat mirror finish while the top ring and the turntable are rotating. In the conventional polishing apparatus, a nonwoven fabric cloth is often used as a polishing cloth for polishing the semiconductor wafer having a device pattern thereon.

However, the recent higher integration of IC or LSI demands a more and more planarized finish of the semiconductor wafer. In order to satisfy such a demand, harder materials, such as polyurethane foam, have been recently used as the polishing cloth. After, for example, one or more semiconductor wafers have been polished by bringing the semiconductor wafer in to sliding contact with the polishing cloth and rotating the turntable, abrasive grains in the abrasive liquid or ground-off particles of the semiconductor wafer are attached to the polishing cloth. In the case of the nonwoven fabric cloth, the polishing cloth is napped. In the case where the semiconductor wafers are repeatedly polished by the same polishing cloth, the polishing performance of the polishing cloth is degraded, thus lowering the polishing rate and causing a nonuniform polishing action. Therefore, after polishing a semiconductor wafer or during polishing of a semiconductor wafer, the polishing cloth is processed to recover its original polishing capability by a dressing process.

For a dressing process for recovering the polishing capability of the polishing cloth made of relatively hard material such as polyurethane foam, there has been proposed a dresser having diamond grains. This dressing process using the diamond grain dresser is effective in restoring the polishing capability of the polishing cloth and tends not to rapidly lower the polishing rate thereof.

To be more specific, the dressing process is classified into two processes, one of which is a process for raising the napped polishing cloth by a blush, water jet or gas jet and washing out the remaining abrasive grains or the ground-off particles from the polishing cloth, and the other of which is a process for scraping off a surface of the polishing cloth by diamond or SiC to create a new surface of the polishing cloth. In the former case, even if the dressing is not uniformly performed over the entire dressing area of the polishing cloth, the polished surface of the semiconductor wafer is not greatly affected by the thus dressed polishing cloth. However, in the latter case, the polished surface of the semiconductor wafer is greatly affected by the polishing cloth which has been nonuniformly dressed.

Conventionally, the polishing apparatus having a diamond grain dresser comprises a top ring for holding the semiconductor wafer and pressing the semiconductor wafer against a polishing cloth on a turntable, and a dresser for dressing the surface of the polishing cloth, the top ring and the dresser being supported by respective heads. The dresser is connected to a motor provided on the dresser head. The dresser is pressed against the surface of the polishing cloth while the dresser is rotated about its central axis and the dresser head is swung, thereby dressing a certain area of the polishing cloth which is to be used for polishing. That is, the dressing of the polishing cloth is performed by rotating the turntable, pressing the rotating dresser against the polishing cloth, and moving the dresser radially of the polishing cloth by swinging the dresser head. In the conventional dressing process, the rotational speed of the dresser is equal to the rotational speed of the turntable.

However, when the polishing cloth is dressed by the diamond grain dresser, the polishing cloth is slightly scraped off. Unless the polishing cloth is uniformly scraped off in any vertical cross section, i.e., is uniformly scraped off in a radial direction of the polishing cloth, the semiconductor wafer, which is a workpiece to be polished, cannot be uniformly polished as the number of dressing processes increases. It is confirmed by the inventors of the present application that when the dressing is performed in such a manner that the rotational speed of the dresser is equal to the rotational speed of the turntable, the amount of material removed from the inner circumferential region of the polishing cloth is greater than the amount of material removed from the outer circumferential region of the polishing cloth.

FIG. 6 shows measurements of the removal amount of material in the polishing cloth which has been dressed by the conventional dressing method. In FIG. 6, the horizontal axis represents a distance from a center of rotation, i.e., a radius (cm) of the polishing cloth, and the vertical axis represents the amount of material removed from the polishing cloth, which is expressed by a removal thickness (mm) of material. FIG. 6 shows measurements of the removal thickness when the rotational speeds of the dresser and the turntable were the same and about 500 semiconductor wafers were polished on the polishing cloth and the corresponding number of dressing processes were applied to the polishing cloth. Two kinds of diamond grain sizes were used in the experiment. For example, the rotational speed of the turntable was 13 rpm, the rotational speed of the dresser was 13 rpm, 500 semiconductor wafers were polished on the polishing cloth made of polyurethane foam and to corresponding number of the dressing processes were applied to the polishing cloth. In this case, the difference in a removal thickness of material between the outer circumferential region and the inner circumferential region of the polishing cloth was about 100 μm.

SUMMARY OF THE INVENTION

It is therefore an object of the present invention to provide a method and apparatus for dressing a polishing cloth which can uniformly scrape off the polishing cloth in a radial direction thereof.

According to one aspect of the present invention, there is provided a method of dressing a polishing cloth mounted on a turntable by bringing a dresser into contact with the polishing cloth, comprising measuring heights of a surface of the polishing cloth at radial positions of the polishing cloth in a radial direction thereof, determining a rotational speed of the dresser with respect to a rotational speed of the turntable on the basis of the measured heights, and dressing the polishing cloth by pressing the dresser against the polishing cloth while the turntable and the dresser are rotating.

According to another aspect of the present invention, there is provided a method of dressing a polishing cloth mounted on a turntable by bringing a dresser in contact with the polishing cloth, comprising, setting a rotational speed of the dresser with respect to a rotational speed of the turntable so that the rotational speed of the dresser is lower than the rotational speed of the turntable, and dressing the polishing cloth by pressing the dresser against the polishing cloth while the turntable and the dresser are rotating.

According to still another aspect of the present invention, there is provided an apparatus for dressing a polishing cloth mounted on a turntable, comprising, a dresser for contacting the polishing cloth, an actuator for rotating the dresser about a central axis of the dresser, and a measuring device for measuring heights of a surface of the polishing cloth at radial positions of the polishing cloth in a radial direction thereof. A rotational speed of the dresser with respect to a rotational speed of the turntable is determined on the basis of the measured heights, and the polishing cloth is dressed by pressing the dresser against the polishing cloth while the turntable and the dresser are rotating.

The above and other objects, features, and advantages of the present invention will become apparent from the following description when taken in conjunction with the accompanying drawings, which illustrate a preferred embodiment of the present invention by way of examples.

DETAILED DESCRIPTION OF THE PREFERRED EMBODIMENTS

The dressing apparatus according to an embodiment of the present invention will be described below with reference to FIGS. 1 through 5.

Figure 1:
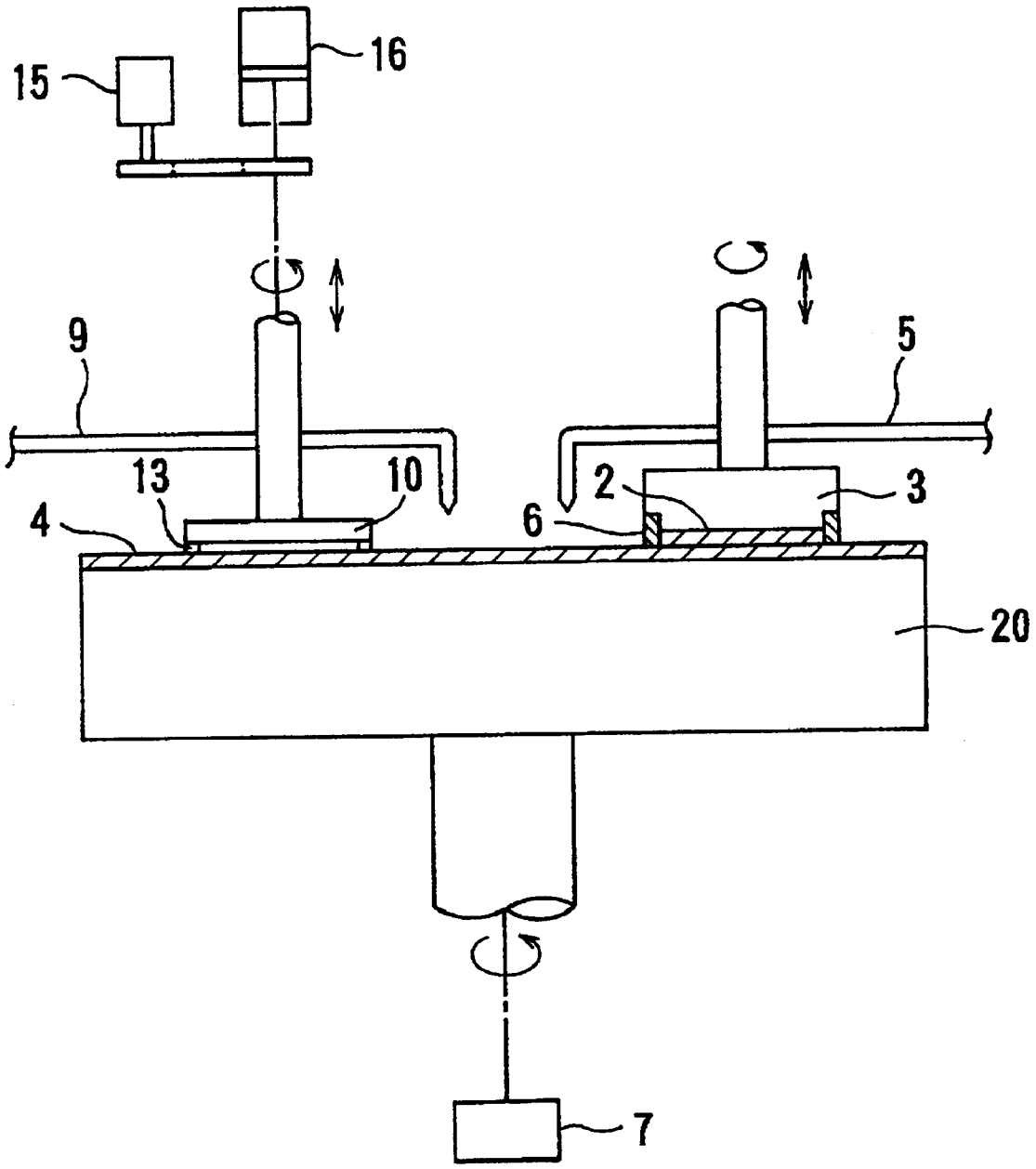
FIG. 1 is a vertical cross-sectional view of a polishing apparatus having a dressing apparatus according to an embodiment of the present invention.

A dressing apparatus is installed in a polishing apparatus in FIG. 1. As shown in FIG. 1, the polishing apparatus comprises a turntable 20, and a top ring 3 positioned above the turntable 20 for holding a semiconductor wafer 2 and pressing the semiconductor wafer 2 against the turntable 20. The turntable 20 is coupled to a motor 7 and is rotatable about its own axis as indicated by an arrow. A polishing cloth 4 (for example, IC-1000 manufactured by Rodel Products Corporation) is mounted on the upper surface of the turntable 20.

The top ring 3 is coupled to a motor and also to a lifting/lowering cylinder (not shown). The top ring 3 is vertically movable and rotatable about its own axis as indicated by arrows by the motor and the lifting/lowering cylinder. The top ring 3 can therefore press the semiconductor wafer 2 against the polishing cloth 4 under a desired pressure. The semiconductor wafer 2 is attached to a lower surface of the top ring 3 under a vacuum or the like. A guide ring 6 is mounted on the outer circumferential edge of the lower surface of the top ring 3 for preventing the semiconductor wafer 2 from being disengaged from the top ring 3.

An abrasive liquid supply nozzle 5 is disposed above the turntable 20 for supplying an abrasive liquid onto the polishing cloth 4 attached to the turntable 20. A dresser 10 for performing dressing of the polishing cloth 4 is positioned in diametrically opposite relation to the top ring 3. The polishing cloth 4 is supplied with a dressing liquid such as water from a dressing liquid supply nozzle 9 extending over the turntable 20. The dresser 10 is coupled to a motor 15 and also to a lifting/lowering cylinder 16. The dresser 10 is vertically movable and rotatable about its own axis as indicated by arrows by the motor 15 and the lifting/lowering cylinder 16.

The dresser 10 has an annular diamond grain layer 13 on its lower surface. The dresser 10 is supported by a dresser head (not shown) and is movable in a radial direction of the polishing cloth 4. The abrasive liquid supply nozzle 5 and the dressing liquid supply nozzle 9 extend to a region near the central axis of the turntable 20 above the upper surface thereof for supplying the abrasive liquid and the dressing liquid such as water, respectively, to the polishing cloth 4 at a predetermined position thereon.

The polishing apparatus operates as follows. The semiconductor wafer 2 is held on the lower surface of the top ring 3, and is pressed against the polishing cloth 4 on the upper surface of the turntable 20. The turntable 20 and the top ring 3 are rotated relatively to each other to thereby bring the lower surface of the semiconductor wafer 2 in sliding contact with the polishing cloth 4. At this time, the abrasive liquid nozzle 5 supplies the abrasive liquid to the polishing cloth 4. The lower surface of the semiconductor wafer 2 is now polished by a combination of a mechanical polishing action of abrasive grains in the abrasive liquid and a chemical polishing action of an alkaline solution in the abrasive liquid.

The polishing process comes to an end when the semiconductor wafer 2 is polished to a predetermined thickness of a surface layer thereof. When the polishing process is finished, the polishing properties of the polishing cloth 4 have been changed and the polishing performance of the polishing cloth 4 deteriorates. Therefore, the polishing cloth 4 is dressed to restore its polishing properties.

Figure 2A:
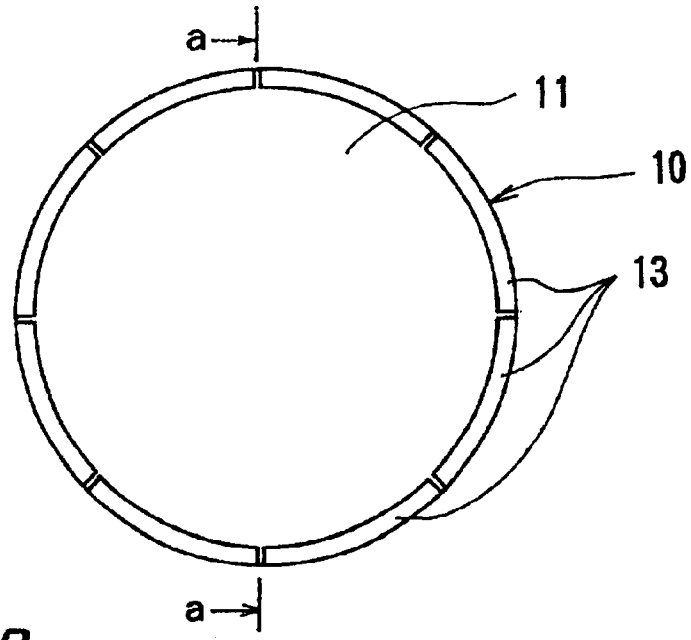
FIG. 2A is a bottom view of a dresser according to an embodiment of the present invention.
Figure 2B:
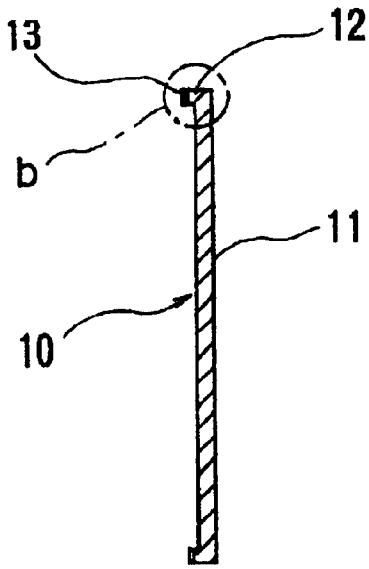
FIG. 2B is a cross-sectional view taken along line a—a of FIG. 2A.
Figure 2C:
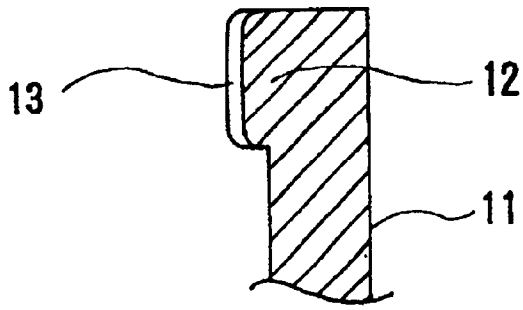
FIG. 2C is an enlarged view of a section b of FIG. 2B.

In an embodiment of the present invention, an apparatus for dressing a polishing cloth has a dresser 10 shown in FIGS. 2A through 2C. FIG. 2A is a bottom view of the dresser 10, FIG. 2B is a cross-sectional view taken along the line a—a of FIG. 2A, and FIG. 2C is an enlarged view showing a portion b of FIG. 2B.

The dresser 10 comprises a dresser body 11 of a circular plate, an annular projecting portion 12 which projects from an outer circumferential portion of the dresser body 11, and an annular diamond grain layer 13 on the annular projecting portion 12. The annular diamond grain layer 13 is made of diamond grains which are electrodeposited on the annular projecting portion 12. The diamond grains are deposited on the annular projecting portion 12 by nickel plating. The sizes of the diamond grains are in the range of 10 to 40 $\mu$m.

One example of the dresser 10 is as follows. The dresser body 11 has a diameter of 250 mm. The annular diamond grain layer 13, having a width of 6 mm, is formed on the circumferential area of the lower surface of the dresser body 11. The annular diamond grain layer 13 comprises a plurality of sectors (eight in this embodiment). The diameter of the dresser body 11 is larger than the diameter of the semiconductor wafer 2, which is a workpiece to be polished. Thus, the dressed surface of the polishing cloth has margins at inner and outer circumferential regions with respect to the surface of the semiconductor wafer being polished.

Figure 3:
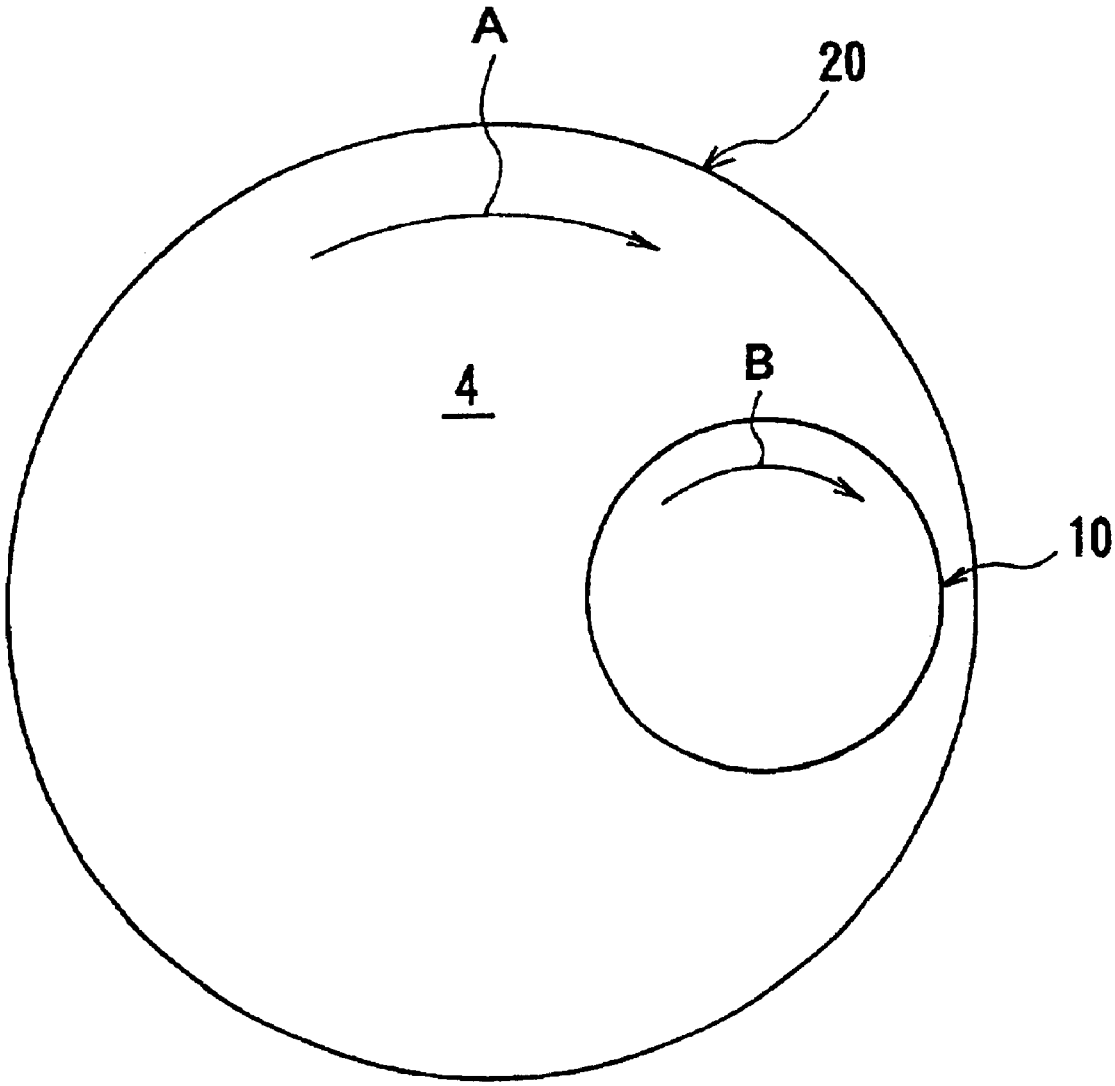
FIG. 3 is a plan view showing an arrangement of the dresser and a polishing cloth mounted on a turntable according to the embodiment of the present invention.

The polishing cloth is dressed by the dresser in a manner shown in FIG. 3. The polishing cloth 4 made of polyurethane foam to be dressed is attached to the upper surface of the turntable 20, which rotates in a direction indicated by the arrow A. The dresser 10, which rotates in a direction indicated by the arrow B, is pressed against the polishing cloth so that the annular diamond grain layer 13 is brought in contact with the polishing cloth 4. The turntable 20 and the dresser 10 are rotated relative to each other to thereby bring the lower surface of the diamond grain layer 13 in sliding contact with the polishing cloth 4. In this case, the dresser is not swung.

In the polishing apparatus, the turntable 20 is rotated by the motor 7 and the rotational speed of the turntable 20 is variable. The dresser 10 is rotatable by the motor 15 and the rotational speed of the dresser 10 is also variable. Specifically, the rotational speed of the dresser 10 can be set to a desired value which is independent from the rotational speed of the turntable 20.

In the embodiments of dressing processes described below, the rotational speed ratios of the turntable to the dresser are 20 rpm:12 rpm, 50 rpm:30 rpm, and 150 rpm:90 rpm, which are each set to a ratio of 1:0.6.

Figure 4:
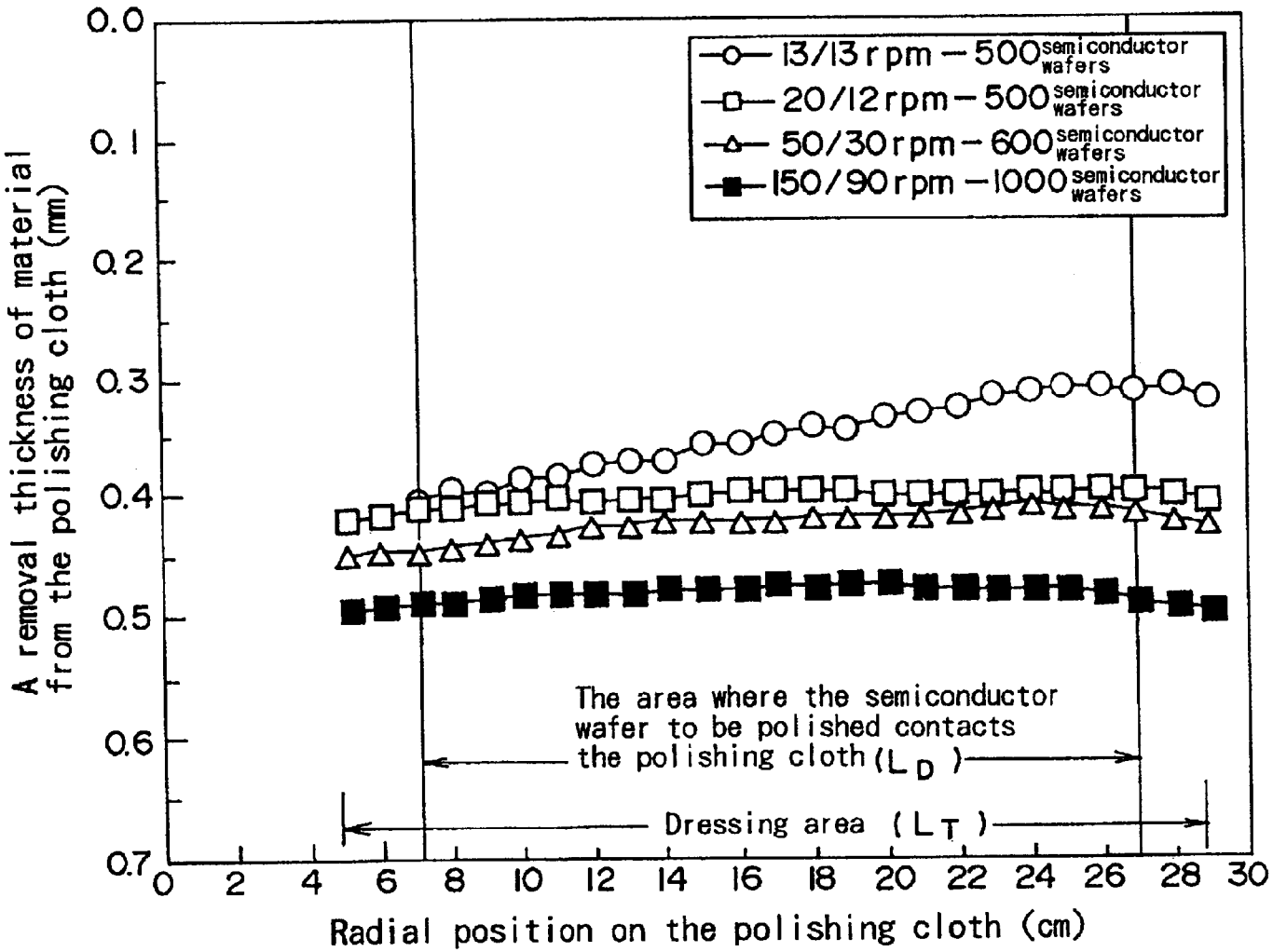
FIG. 4 is a graph showing measurements of the removal thickness of material in the polishing cloth which has been dressed according to the embodiment of the present invention.

FIG. 4 is a graph showing measurements of the removal thickness of material in the polishing cloth which has been dressed according to the embodiment of the present invention. In FIG. 4, the horizontal axis represents a radial position on the polishing cloth (cm), and the vertical axis represents a removal thickness (mm) of material from the polishing cloth. $L_T$ represents the area where the dresser contacts the polishing cloth. The dresser 10 is pressed against the polishing cloth 4 at a pressure of 450 gf/cm$^2$. As described above, the dressing area ($L_T$) is larger than the area ($L_D$) where the semiconductor wafer to be polished contacts the polishing cloth to provide margins at inner and outer circumferential regions of the polishing cloth in a radial direction thereof.

In FIG. 4, an open symbol ○ represents a verification example of the conventional dressing method. That is, the rotational speed of the turntable is 13 rpm and the rotational speed of the dresser is 13 rpm. In this case, as described above, the removal thickness of material from the polishing cloth is greater at the inner circumferential region than at the outer circumferential region of the polishing cloth. In contrast, an open symbol □ represents a verification example in which the rotational speed of the turntable is 20 rpm and the rotational speed of the dresser is 12 rpm. In this case, the removal thickness of material from the polishing cloth is substantially uniform at all radial positions of the polishing cloth in a radial direction thereof. An open symbol Δ represents a verification example in which the rotational speed of the turntable is 50 rpm and the rotational speed of the dresser is 30 rpm. In this case also, the removal thickness of material from the polishing cloth is substantially uniform at all radial positions of the polishing cloth in a radial direction thereof. A solid symbol ■ is a verification example in which the rotational speed of the turntable is 150 rpm and the rotational speed of the dresser is 90 rpm. In this case also, the removal thickness of material from the polishing cloth is substantially uniform at all radial positions of the polishing cloth in a radial direction of the dressing area ($L_T$).

In the above examples, the rotational speed ratio of the turntable to the dresser is 1:0.6, however, the removal thickness of material from the polishing cloth is greater as the absolute value of the rotational speed is larger. Further, it is confirmed from the experiments by the inventors of the present application that in the case where the rotational speed ratio of the turntable to the dresser is in the range of 1:0.4 to 1:0.85, the removal thickness of material from the polishing cloth is substantially uniform at all radial positions of the polishing cloth in a radial direction thereof.

As described above, according to the present invention, the rotational speed ratio of the turntable to the dresser is set to be in the range of 1:0.4 to 1:0.85, and the removal thickness of material from the polishing cloth is substantially uniform at all radial positions of the polishing cloth in a radial direction thereof. As a result, when polishing a semiconductor wafer by the thus dressed polishing cloth, the polished surface of the semiconductor wafer becomes flat.

Next, the theory in which the removal thickness of material from the polishing cloth is substantially uniform from the inner circumferential region to the outer circumferential region of the polishing cloth by setting the rotational speed ratio of the turntable to the dresser to a range of 1:0.4 to 1:0.85 will be described. This theory is based on the assumption that the relative velocity between the dresser and the polishing cloth affects the amount of material removed from the polishing cloth, and the amount of material removed from the polishing cloth is greater as the relative velocity is larger.

Figure 5A:
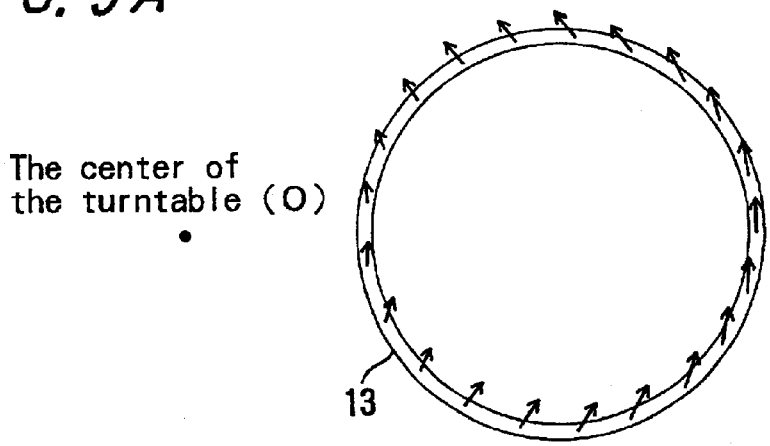
FIG. 5A is a view showing the distribution of relative velocity vectors when a rotational speed ratio of the turntable to the dresser is 1:0.5.
Figure 5B:
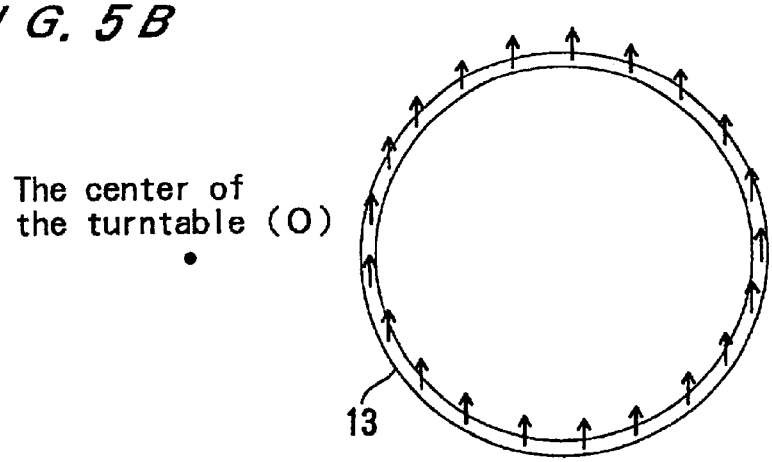
FIG. 5B is a view showing the distribution of relative velocity vectors when a rotational speed ratio of the turntable to the dresser is 1:1.
Figure 5C:
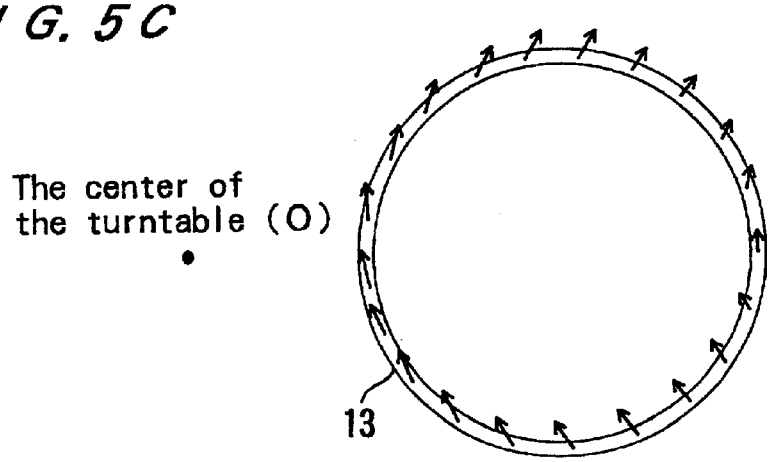
FIG. 5C is a view showing the distribution of relative velocity vectors when a rotational speed ratio of the turntable to the dresser is 1:1.5.

FIGS. 5A, 5B and 5C show the distribution of relative velocity vectors between the polishing cloth and the dresser.

The center (O) of the turntable is located at the left side of the dresser. FIG. 5A shows a verification example in which the rotational speed of the turntable is 100 rpm and the rotational speed of the dresser is 50 rpm. FIG. 5B shows a verification example in which the rotational speeds of the turntable and the dresser are 100 rpm, respectively. FIG. 5C shows a verification example in which the rotational speed of the turntable is 100 rpm and the rotational speed of the dresser is 150 rpm, i.e., the rotational speed of the dresser is higher than that of the turntable. In FIGS. 5A, 5B and 5C, "O" represents a center of the turntable 20 and; a number of arrows in the annular diamond grain layer 13 of the dresser 10 represent relative velocity vectors, which are vectors of relative velocities between the diamond grain layer 13 and the polishing cloth 4 at respective positions. As the absolute value of the relative velocity vector is larger, the removal thickness of material from the polishing cloth is greater at the position concerned. As in the conventional method, when the rotational speed of the dresser is equal to the rotational speed of the turntable, the relative velocity vectors are uniform in all areas which are dressed by the dresser 10 as shown in FIG. 5B. In this condition, the removal thickness of material from the polishing cloth is greater at the inner circumferential region of the polishing cloth, which is nearer to the center (O) of the turntable, and the removal thickness of material from the polishing cloth is smaller at the outer circumferential region, which is farther away from the center (O) of the turntable. Therefore, in order to correct nonuniform tendency of the removal thickness of material from the polishing cloth, it is desirable that the relative velocity be higher at the outer circumferential region, which is farther away from the center (O) of the turntable, and the relative velocity be lower at the inner circumferential region, which is nearer to the center (O) of the turntable.

As shown in FIG. 5A, when the rotational speed of the dresser is lower than the rotational speed of the turntable, the relative velocity is lower at the inner circumferential region, which is nearer to the center (O) of the turntable, and is higher at the outer circumferential region, which is farther away from the center (O) of the turntable. Therefore, the removal thickness of material from the polishing cloth is smaller at the inner circumferential region of the polishing cloth and is greater at the outer circumferential region of the polishing cloth, because as the absolute value of the relative velocity vector is larger, the removal thickness of material from the polishing cloth is greater at the position concerned.

Figure 6:
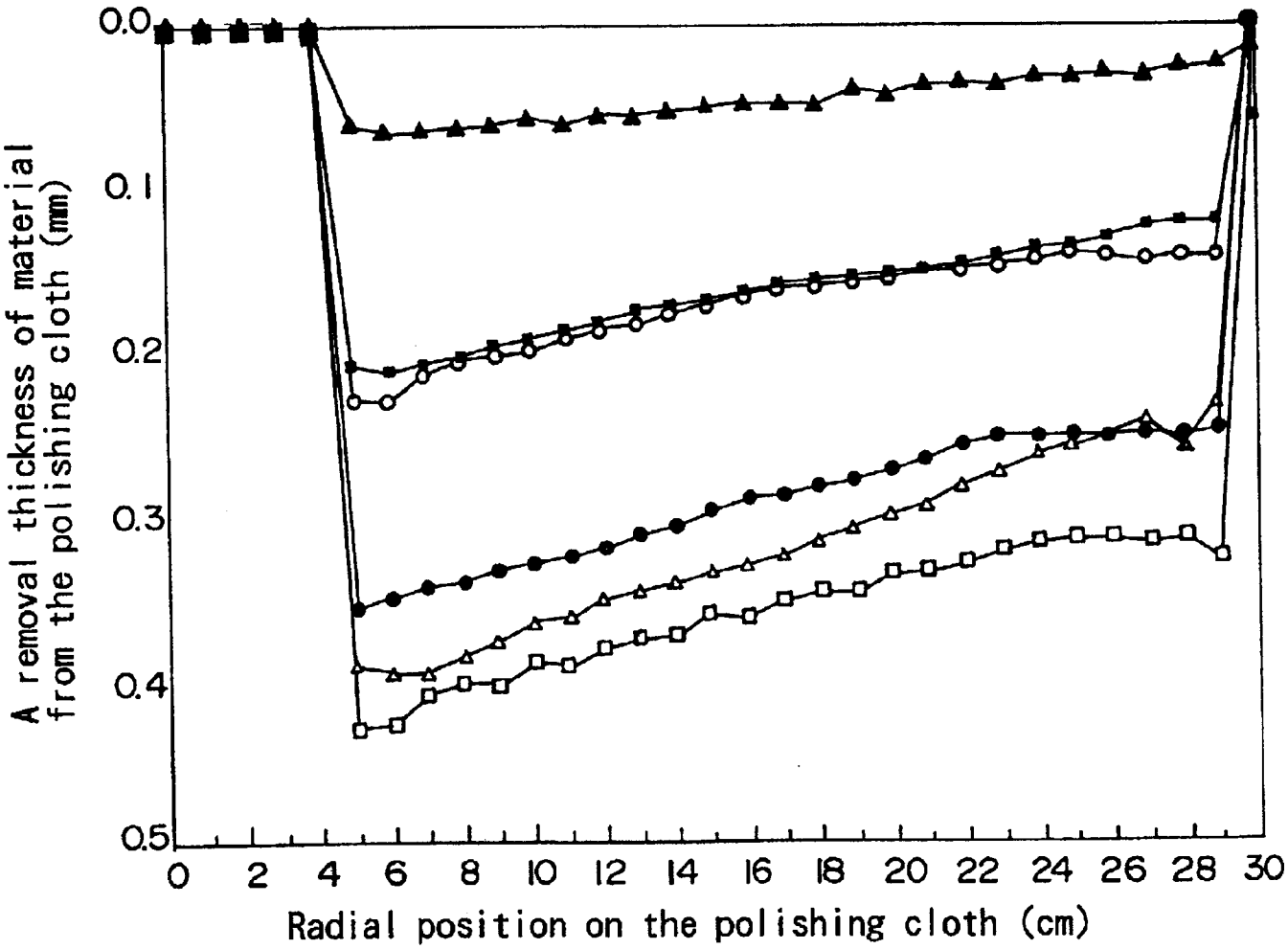
FIG. 6 is a graph showing measurements of the removal thickness of material in the polishing cloth which has been dressed according to the conventional method.

On the other hand, in the case where the rotational speed of the turntable is equal to the rotational speed of the dresser, the relative velocity vectors are uniform at all positions as shown in FIG. 5B. In this case, as shown in FIG. 6, the removal thickness of material from the polishing cloth is greater at the inner circumferential region of the polishing cloth and is smaller at the outer circumferential region thereof. Therefore, by combination of the tendency shown in FIG. 6 and the tendency shown in FIG. 5A, in which the relative velocity is higher at the outer circumferential region of the polishing cloth, i.e., by making the rotational speed of the dresser lower than the rotational speed of the turntable, the removal thickness of material from the polishing cloth is substantially uniform at all radial positions of the polishing cloth in a radial direction thereof.

In the embodiment shown in FIG. 2, the dresser is provided with the annular diamond grain layer made of diamond grains which are electrodeposited on the annular projecting portion. However, silicon carbide (SiC) may be used instead of diamond grains. Further, the material and structure of the dresser may be freely selected, and the same dressing effect may be obtained by utilizing the above principles.

Figure 7:
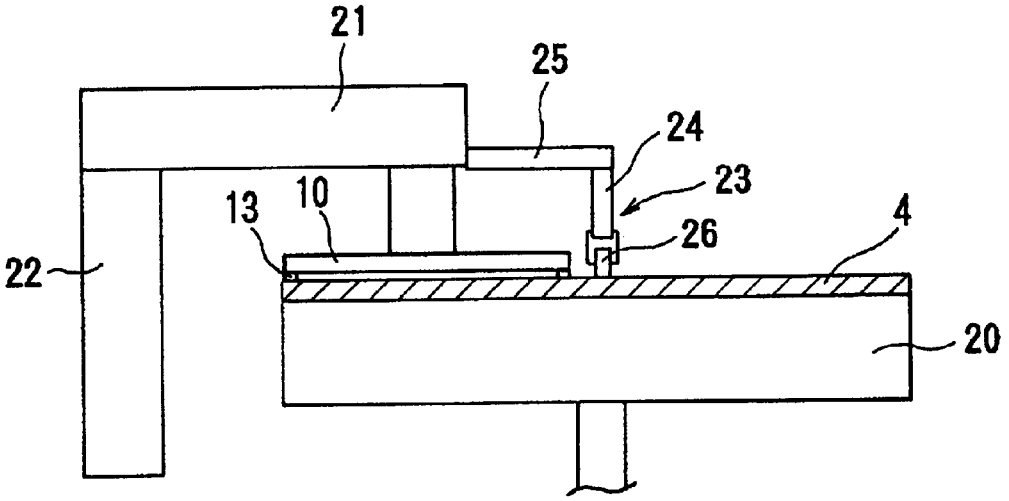
FIG. 7 is a side view of the dressing apparatus according to an embodiment of the present invention.
Figure 8:
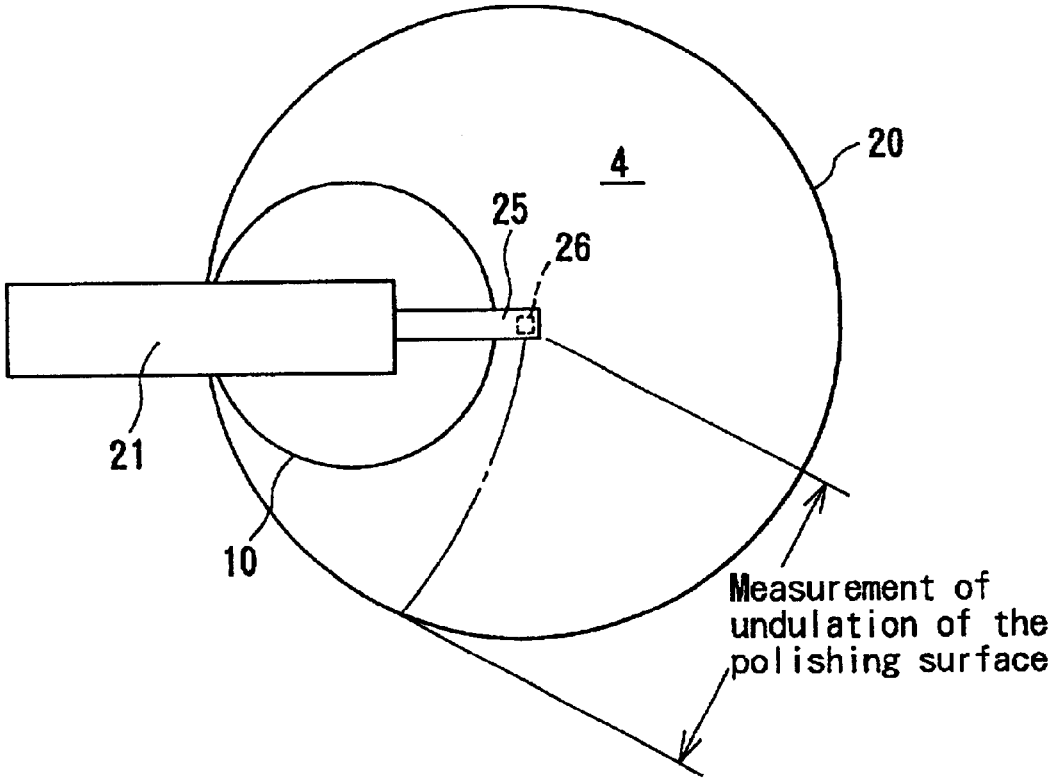
FIG. 8 is a plan view of the dressing apparatus shown in FIG. 7.

Next, the dressing apparatus for obtaining a desired surface of the polishing cloth by utilizing the above principles will be described below with reference to FIGS. 7 and 8. As shown in FIG. 7, the dresser 10 having the annular diamond grain layer 13 is supported by a dresser head 21 which is supported by a rotating shaft 22. A measuring device 23 for measuring a surface contour of the polishing cloth 4 is fixed to the dresser head 21. The measuring device 23 comprises a measuring unit 24 comprising a micrometer, a support unit 25 for supporting the measuring unit 24, and a contact 26 comprising a roller which is fixed to the forward end of the measuring unit 24.

Figure 9:
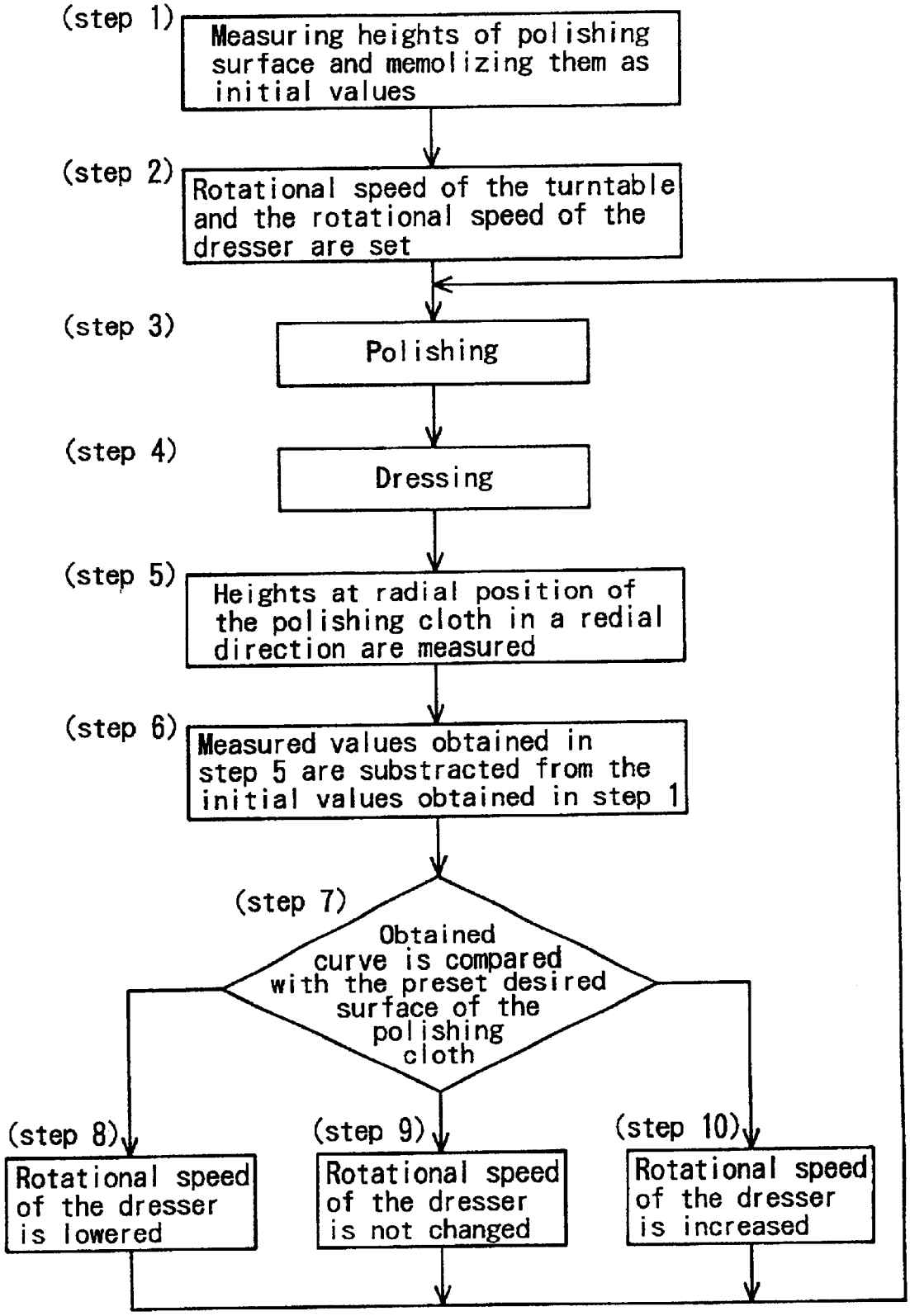
FIG. 9 is a flow chart showing steps of the dressing process according to the embodiment of the present invention.

As shown in FIG. 7, the rotation of the turntable 20 is stopped, the contact 26 contacts the surface of the polishing cloth 4, and the dresser head 21 is swung about the rotating shaft 22 by rotating the rotating shaft 22 about its own axis. Thus, as shown in FIG. 8, the contact 26 is moved radially while it contacts the surface of the polishing cloth 4, and the heights at radial positions of the polishing cloth in a radial direction thereof are measured during movement of the contact 26. That is, the surface contour, i.e., the undulation of the surface of the polishing cloth 4 in a radial direction thereof, is measured. Since the dressing liquid such as water remains on the surface of the polishing cloth 4, the contact type of sensor is desirable to measure the surface contour, rather than a noncontact type of sensor, when measuring the undulation of the surface of the polishing cloth. Next, the processes for using the dressing apparatus shown in FIGS. 7 and 8 will be described below with reference to FIG. 9.

Figure 10:
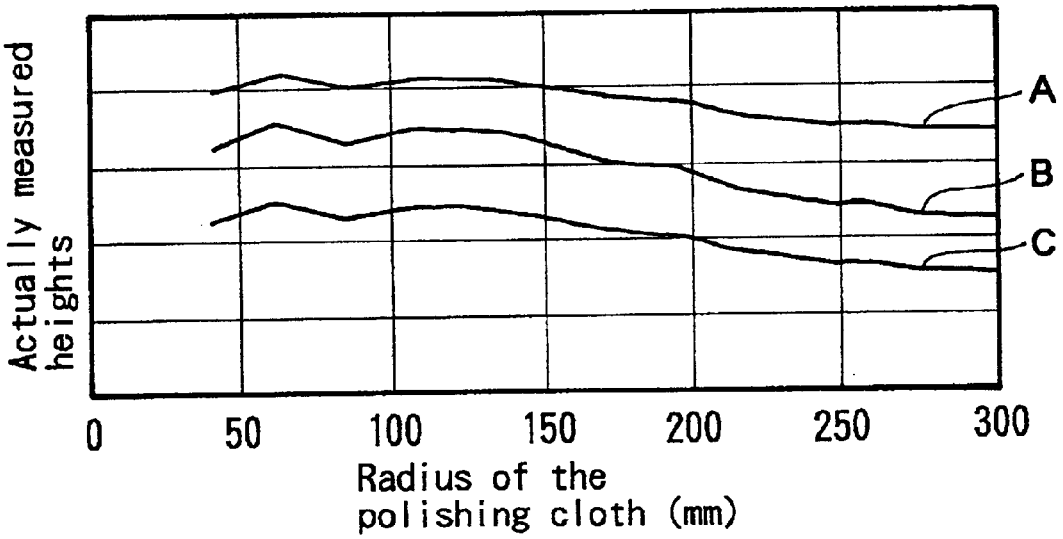
FIG. 10 is a graph showing heights of a surface of the polishing cloth at radial positions of the polishing cloth in a radial direction thereof, measured by a measuring device of the dressing apparatus according to the embodiment of the present invention.

In step 1, the heights at radial positions of the polishing cloth in a radial direction thereof are measured, and the obtained values which are set to initial values are memorized. FIG. 10 shows the heights of the surface of the polishing cloth at radial positions of the polishing cloth in a radial direction thereof. In FIG. 10, the horizontal axis represents a radius (mm) of the polishing cloth, and the vertical axis represents the heights which are actually measured. In FIG. 10, the curve A shows initial values which are the heights at radial positions of the polishing cloth in a radial direction thereof. In step 2, the rotational speed of the turntable 20 and the rotational speed of the dresser 10 are set. In step 3, the semiconductor wafer 2 is polished by the use of the polishing cloth 4 while supplying the abrasive liquid from the abrasive liquid supply nozzle 5 (see FIG. 1). In step 4, the dressing of the polishing cloth 4 is performed by the dresser 10.

Next, in step 5, the heights at radial positions of the polishing cloth in a radial direction thereof are measured by the measuring device 23. In FIG. 10, the curve B shows the heights at radial positions of the polishing cloth in a radial direction thereof when the rotational speed ratio of the turntable to the dresser is 1:0.5. The curve C shows the heights at radial positions of the polishing cloth in a radial direction thereof when the rotational speed ratio of the turntable to the dresser is 1:0.7.

Figure 11:
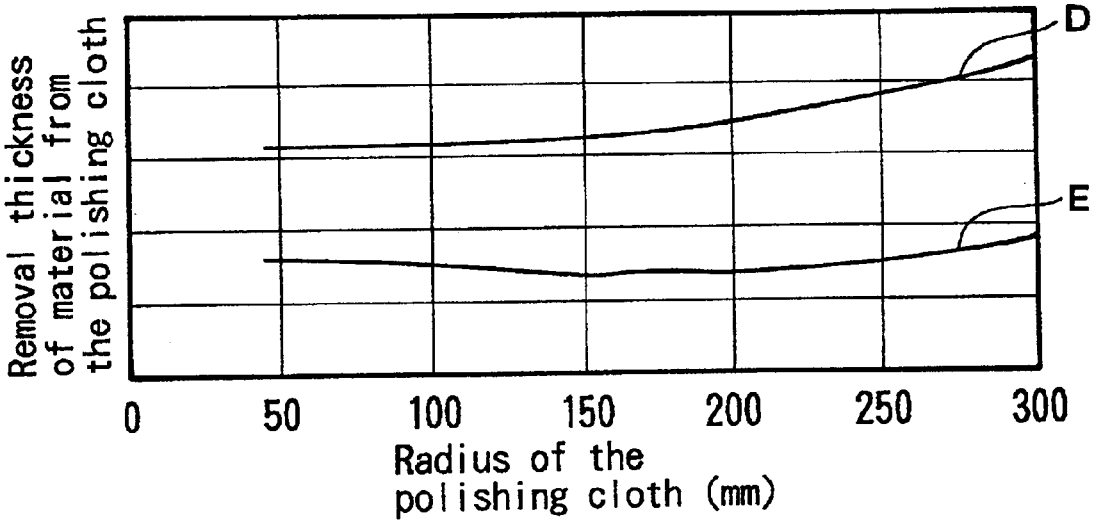
FIG. 11 is a graph showing a removal thickness of material in a radial direction of the polishing cloth which has been dressed by the dressing apparatus of the present invention.

Next, in step 6, the measured values obtained in step 5 are subtracted from the initial values obtained in step 1 to obtain the removal thickness of material from the polishing cloth at radial positions of the polishing cloth in a radial direction thereof. FIG. 11 shows the removal thickness of material from the polishing cloth at radial positions of the polishing cloth in a radial direction thereof. In FIG. 11, the horizontal axis represents the radius (mm) of the polishing cloth, and the vertical axis represents the removal thickness of material from the polishing cloth. In FIG. 11, the curve D shows the removal thickness of material at radial positions of the polishing cloth in a radial direction thereof when the rotational speed ratio of the turntable to the dresser is 1:0.5. The curve E shows the removal thickness of material at radial positions of the polishing cloth in a radial direction thereof when the rotational speed ratio of the turntable to the dresser is 1:0.7.

Next, in step 7, the obtained curve, such as the curve D or E, is compared with the preset desired surface of the polishing cloth. If the removal thickness of material from the polishing cloth is greater at the inner circumferential region than at the outer circumferential region, the rotational speed of the dresser 10 is lowered in step 8. If the removal thickness of material from the polishing cloth is in an allowable range at the inner and outer circumferential regions, the rotational speed of the dresser 10 is not changed in step 9. If the removal thickness of material from the polishing cloth is greater at the outer circumferential region than at the inner circumferential region, the rotational speed of the dresser 10 is increased in step 10. In steps 8 through 10, the rotational speed of the turntable is not changed. After setting the rotational speed of the dresser 10 to an optimum value in steps 8 through 10, a next dressing process is performed by the set value of the rotational speed of the dresser 10.

In the above embodiments, the heights of a surface of the polishing cloth at radial positions of the polishing cloth are measured. The heights of the surface of the polishing cloth are directly related to the thickness of the polishing cloth. That is, irregularities of the removal thickness of material from the polishing cloth cause irregularities of the thickness of the polishing cloth, resulting in irregularities of the heights of the surface of the polishing cloth. To correct the heights of the surface of the polishing cloth corresponds to correction of the thicknesses of the surface of the polishing cloth. In the embodiments, the contact type of the sensor is used to measure the heights of the polishing cloth, and the surface contour of the polishing cloth is controlled on the basis of the measured values. It is also possible to control the surface contour of the polishing cloth by measuring the thicknesses of the polishing cloth with a thickness detector and utilizing the measured values.

Further, in the embodiments, the surface contour of the polishing cloth is controlled so as to be flat by the dressing process. However, in some cases, the surface of the turntable may be slightly convex, and thus the surface of the polishing cloth mounted on the turntable may be slightly convex in accordance with the purpose or condition of the polishing process. In this case, the surface contour of the polishing cloth may be controlled so as to be slightly convex by adjusting a rotational speed ratio of the turntable to the dresser according to the present invention.

In the embodiments, although the annular diamond grain layer and the annular SiC layer have a circular outer shape and a circular inner shape, respectively, they may have an elliptical outer shape and an elliptical inner shape, respectively, or a circular outer shape and a heart-shaped inner shape, or any other shapes. Further, the dresser may have a solid circular diamond layer or a solid circular SiC layer without having a hollow portion. The dresser may also comprise a dresser body, and a plurality of small circular contacting portions made of diamond grains and arranged in a circular array on the dresser body.

As is apparent from the above description, the present invention offers the following advantages.

Since the heights of the surface of the polishing cloth at radial positions of the polishing cloth in a radial direction thereof are measured, the rotational speed of the dresser relative to the rotational speed of the turntable is determined on the basis of the measured values, and a dressing process is performed in the determined rotational speed ratio of the turntable to the dresser. The polishing cloth is thus uniformly dressed in a radial direction to have a desired surface contour from the inner circumferential region to the outer circumferential region thereof.

Further, the polishing cloth is dressed in such a manner that the rotational speed of the dresser is lower than the rotational speed of the turntable. Specifically, the rotational speed ratio of the turntable to the dresser is in the range of 1:0.4 to 1:0.85. The removal thickness of material from the polishing cloth is substantially uniform from the inner region to the outer region of the polishing cloth. Therefore, a workpiece such as a semiconductor wafer having a device pattern thereon can be polished to a flat mirror finish by the use of the thus dressed polishing cloth.

Although certain preferred embodiments of the present invention have been shown and described in detail, it should be understood that various changes and modifications may be made therein without departing from the scope of the appended claims.

What is claimed is:

1. A method of dressing a polishing cloth mounted on a turntable by bringing a dresser in contact with the polishing cloth, comprising:

measuring heights of a surface of said polishing cloth at radial positions of said polishing cloth in a radial direction thereof;

determining a rotational speed of said dresser with respect to a rotational speed of said turntable on the basis of said measured heights; and dressing said polishing cloth by pressing said dresser against said polishing cloth while said turntable and said dresser are rotating.

2. A method according to claim 1, wherein the rotational speed of said dresser is lower than the rotational speed of said turntable.

3. A method according to claim 1, wherein said dresser comprises a dresser body and an annular diamond grain layer provided on said dresser body, said annular diamond grain layer being made of diamond grains which are electrodeposited on said dresser body.

4. A method according to claim 1, wherein said dresser comprises a dresser body and an annular SiC layer provided on said dresser body.

5. A method according to claim 1, wherein said polishing cloth is made of polyurethane foam.

6. A method of dressing a polishing cloth mounted on a turntable by bringing a dresser into contact with the polishing cloth, comprising:

setting a rotational speed of said dresser with respect to a rotational speed of said turntable so that the rotational speed of said dresser is lower than the rotational speed of said turntable; and dressing said polishing cloth by pressing said dresser against said polishing cloth while said turntable and said dresser are rotating with the rotational speed of said dresser lower than the rotational speed of said turntable so that the relative velocity between said dresser and said polishing cloth is greater at an outer circumferential region of the polishing cloth than an inner circumferential region of the polishing cloth and the removal thickness of material from the polishing cloth is substantially uniform at all radial positions of the polishing cloth.

7. A method according to claim 6, wherein a rotational speed ratio of said turntable to said dresser is in the range of 1:0.4 to 1:0.85.

8. A method according to claim 6, wherein said dresser comprises a dresser body and an annular diamond grain layer provided on said dresser body, said annular diamond grain layer being made of diamond grains which are electrodeposited on said dresser body.

9. A method according to claim 6, wherein said dresser comprises a dresser body and an annular SiC layer provided on said dresser body.

10. A method according to claim 6, wherein said polishing cloth is made of polyurethane foam.

11. An apparatus for dressing a polishing cloth mounted on a turntable, comprising:

a dresser for contacting said polishing cloth;

an actuator for rotating said dresser about a central axis of said dresser; and a measuring device for measuring heights of a surface of said polishing cloth at radial positions of said polishing cloth in a radial direction thereof;

wherein a rotational speed of said dresser with respect to a rotational speed of said turntable is determined on the basis of said measured heights, and said polishing cloth is dressed by pressing said dresser against said polishing cloth while said turntable and said dresser are rotating.

12. An apparatus according to claim 11, wherein the rotational speed of said dresser is lower than the rotational speed of said turntable.

13. An apparatus according to claim 11, wherein said dresser comprises a dresser body and an annular diamond grain layer provided on said dresser body, said annular diamond grain layer being made of diamond grains which are electrodeposited on said dresser body.

14. An apparatus according to claim 11, wherein said dresser comprises a dresser body and an annular SiC layer provided on said dresser body.

15. An apparatus according to claim 11, wherein said polishing cloth is made of polyurethane foam.

16. A polishing apparatus for polishing a surface of a workpiece, comprising:

a turntable having a polishing cloth thereon;

an actuator for rotating said turntable about a central axis of said turntable;

a top ring for supporting the workpiece to be polished and pressing the workpiece against said polishing cloth;

a dresser for contacting said polishing cloth;

an actuator for rotating said dresser about a central axis of said dresser; and a measuring device for measuring heights of a surface of said polishing cloth at radial positions of said polishing cloth in a radial direction thereof;

wherein a rotational speed of said dresser with respect to a rotational speed of said turntable is determined on the basis of said measured heights, and said polishing cloth is dressed by pressing said dresser against said polishing cloth while said turntable and said dresser are rotating.

17. A method of dressing a polishing surface of a turntable by bringing a dresser in contact with the polishing surface, said method comprising:

measuring an undulation of said polishing surface in a radial direction thereof, determining a ratio of a rotational speed of said turntable to a rotational speed of said dresser on the basis of measured results from said measuring; and dressing said polishing surface by pressing said dresser against said polishing surface while said dresser is rotating.

18. A method of polishing a workpiece and dressing a polishing surface mounted on a turntable, said method comprising:

polishing the workpiece by pressing the workpiece against said polishing surface;

measuring an undulation of said polishing surface in a radial direction thereof;

determining a ratio of a rotational speed of said turntable to a rotational speed of said dresser on the basis of measured results from said measuring; and dressing said polishing surface by pressing said dresser against said polishing surface while said dresser is rotating.

19. An apparatus according to claim 11, wherein said measuring device is attached to said dresser.

20. An apparatus according to claim 16, wherein said measuring device in attached to said dresser.

* * * * *